US011382375B2

(12) United States Patent
Noordzij et al.

(10) Patent No.: US 11,382,375 B2
(45) Date of Patent: Jul. 12, 2022

(54) MODULAR SHROUD

(71) Applicant: Gentex Corporation, Simpson, PA (US)

(72) Inventors: Duco W. Noordzij, Roslindale, MS (US); Jason W. O'Connell, Raynham, MA (US)

(73) Assignee: GENTEX CORPORATION, Simpson, PA (US)

( * ) Notice: Subject to any disclaimer, the term of this patent is extended or adjusted under 35 U.S.C. 154(b) by 159 days.

(21) Appl. No.: 16/493,537

(22) PCT Filed: Mar. 13, 2018

(86) PCT No.: PCT/US2018/022218
§ 371 (c)(1),
(2) Date: Sep. 12, 2019

(87) PCT Pub. No.: WO2018/169981
PCT Pub. Date: Sep. 20, 2018

(65) Prior Publication Data

US 2020/0000167 A1 Jan. 2, 2020

Related U.S. Application Data

(60) Provisional application No. 62/470,716, filed on Mar. 13, 2017.

(51) Int. Cl.
*A42B 3/04* (2006.01)
*A42B 3/32* (2006.01)

(52) U.S. Cl.
CPC ..... *A42B 3/042* (2013.01); *A42B 3/044* (2013.01)

(58) Field of Classification Search
CPC ..... A42B 3/042; A42B 3/044; A42B 3/04
See application file for complete search history.

(56) References Cited

U.S. PATENT DOCUMENTS 3,130,630 A 4/1964 Dawes
4,224,694 A * 9/1980 Palmaer ..... A42B 3/166 2/422
4,641,382 A * 2/1987 Gessalin ..... A42B 3/326 2/421
4,670,912 A 6/1987 Hart
4,697,783 A 10/1987 Kastendieck et al.
(Continued)

FOREIGN PATENT DOCUMENTS

WO 1999023521 A1 5/1999
WO 2004062400 A2 7/2004
(Continued)

OTHER PUBLICATIONS

Extended European Search Report for European Patent Application No. 18767072.4 dated Nov. 18, 2020, 7 pages.
(Continued)

*Primary Examiner* — Robert H Muromoto, Jr.
(74) *Attorney, Agent, or Firm* — Morgan, Lewis & Bockius LLP

(57) ABSTRACT

A modular shroud system includes a shroud configured to be coupled to a helmet. The modular shroud system further includes a plate configured to be detachably coupled to the shroud. The plate may be configured to be detached from the shroud while the shroud is coupled to the helmet.

20 Claims, 12 Drawing Sheets

(56) References Cited

U.S. PATENT DOCUMENTS 4,700,410 A * 10/1987 Westgate ..... A42B 3/166 2/209
4,809,942 A 3/1989 Kastendieck et al.
4,884,302 A * 12/1989 Foehl ..... A42B 3/222 2/424
4,907,299 A * 3/1990 Arai ..... A42B 3/222 2/424
5,226,181 A * 7/1993 Polednak ..... A42B 3/042 2/422
5,291,880 A * 3/1994 Almovist ..... A62B 18/084 128/201.22
5,333,329 A * 8/1994 Hong ..... A42B 3/222 2/424
5,367,402 A 11/1994 Holmes et al.
5,388,278 A * 2/1995 Taniuchi ..... A42B 3/283 2/422
5,416,922 A 5/1995 Horvat et al.
5,467,479 A 11/1995 Mattes
5,471,678 A * 12/1995 Dor ..... A42B 3/08 2/6.7
5,506,730 A 4/1996 Morley et al.
5,542,627 A 8/1996 Crenshaw et al.
5,590,209 A * 12/1996 Pratt ..... H04R 1/083 381/362
5,675,843 A * 10/1997 Grim ..... A42B 3/227 2/12
5,718,500 A * 2/1998 Vinci guerra ..... A61F 9/028 2/171.3
5,796,374 A * 8/1998 Cone ..... G02B 27/0176 345/8
5,914,816 A 6/1999 Soto et al.
5,987,651 A * 11/1999 Tanaka ..... A42B 3/223 2/424
5,991,085 A * 11/1999 Rallison ..... G02B 27/017 345/8
6,160,666 A * 12/2000 Rallison ..... G02B 27/0101 345/7
6,185,739 B1 * 2/2001 Verkic ..... A61F 9/06 2/8.1
6,263,549 B1 * 7/2001 Uehara ..... A44B 11/266 24/625
6,457,179 B1 * 10/2002 Prendergast ..... A42B 3/04 2/422
6,472,776 B1 10/2002 Soto et al.
6,557,185 B1 * 5/2003 Lee ..... A42B 3/222 2/424
6,622,313 B1 * 9/2003 Choi ..... A42B 3/222 2/12
6,662,370 B1 * 12/2003 Buchanan, Jr. ..... A42B 3/04 2/422
6,751,810 B1 * 6/2004 Prendergast ..... A42B 3/04 2/422
6,811,348 B1 11/2004 Meyer et al.
6,842,913 B1 * 1/2005 Song ..... A42B 3/222 2/424
6,851,129 B2 * 2/2005 Gafforio ..... A42B 3/222 2/424
6,862,748 B2 3/2005 Prendergast
6,904,147 B2 * 6/2005 Lenz ..... H04M 1/05 379/430
6,935,458 B2 * 8/2005 Owens ..... H04R 1/086 181/205
6,938,276 B1 9/2005 Prendergast
6,957,449 B2 * 10/2005 Prendergast ..... A42B 3/04 2/422
6,986,162 B2 1/2006 Soto et al.
7,004,439 B1 2/2006 Taylor et al.
7,181,777 B2 * 2/2007 Choi ..... A42B 3/222 2/424
7,219,370 B1 * 5/2007 Teetzel ..... A42B 3/04 2/422
7,234,173 B2 * 6/2007 McCalla ..... A42B 3/04 2/422
7,418,738 B2 * 9/2008 Prendergast ..... A42B 3/04 2/22
7,444,683 B2 11/2008 Prendergast et al.
7,504,918 B2 3/2009 Prendergast et al.
7,649,701 B2 1/2010 Prendergast et al.
7,715,125 B2 5/2010 Willey
7,729,063 B2 6/2010 Willey et al.
7,735,159 B2 6/2010 Prendergast
7,805,776 B2 10/2010 Crossman et al.
7,810,168 B2 10/2010 Reed et al.
D635,305 S 3/2011 Lebel et al.
7,996,917 B2 8/2011 Prendergast
8,087,100 B2 1/2012 Aguero et al.
8,091,149 B2 * 1/2012 Choi ..... A42B 3/222 2/424
8,120,857 B2 * 2/2012 Hedges ..... A42B 3/04 359/630
8,166,577 B2 * 5/2012 Lee ..... A42B 3/222 2/424
8,181,269 B2 5/2012 Aguero et al.
8,209,780 B1 7/2012 Lemire
8,238,045 B2 8/2012 Prendergast et al.
8,239,971 B2 8/2012 Prendergast
8,337,036 B2 * 12/2012 Soto ..... H01M 50/213 362/105
8,355,208 B1 * 1/2013 Baker ..... G02B 27/0176 359/630
8,375,473 B2 2/2013 Celona et al.
8,381,312 B2 * 2/2013 Seo ..... A61F 9/064 2/8.4
8,531,592 B2 9/2013 Teetzel et al.
D692,620 S 10/2013 Gendron
8,636,375 B2 * 1/2014 Soto ..... A42B 3/04 362/105
8,661,571 B1 * 3/2014 Teetzel ..... F41H 1/04 2/422
8,671,467 B2 * 3/2014 Tack ..... A42B 3/04 2/422
8,677,516 B2 3/2014 Prendergast
8,727,556 B2 5/2014 Swan
8,739,313 B2 * 6/2014 Teetzel ..... G02B 27/0149 2/6.6
8,826,463 B2 9/2014 Teetzel et al.
8,830,575 B2 * 9/2014 Rivkin ..... G02B 23/18 359/409
8,886,046 B2 * 11/2014 Masarik ..... H05K 7/02 398/131
8,908,389 B2 12/2014 Teetzel et al.
8,984,665 B2 * 3/2015 Celona ..... A42B 3/04 2/6.2
9,038,870 B2 * 5/2015 Johnson ..... A45C 11/00 224/181
9,113,129 B2 8/2015 Teetzel et al.
9,116,355 B2 8/2015 Teetzel et al.
9,121,544 B2 * 9/2015 DiCarlo ..... F16M 13/02
9,167,859 B2 10/2015 Bandy et al.
9,243,870 B2 1/2016 Teetzel et al.
D749,794 S 2/2016 Noordzij et al.
9,249,923 B2 * 2/2016 DiCarlo ..... F16M 13/02
D750,847 S 3/2016 Noordzij et al.
9,414,633 B2 * 8/2016 Giroux Bernier ..... A42B 3/221
9,433,252 B2 9/2016 Lebel et al.
D774,704 S 12/2016 Hancock et al.
9,565,885 B2 * 2/2017 Hedges ..... A42B 3/04
9,578,916 B2 2/2017 Daniels et al.
9,622,530 B2 * 4/2017 DiCarlo ..... A42B 3/04
9,625,699 B2 4/2017 Teetzel et al.
9,701,354 B2 * 7/2017 Cheng ..... B62J 11/00
9,705,605 B2 * 7/2017 Masarik ..... H05K 7/02
9,716,938 B1 * 7/2017 Hoernschemeyer ..... H04R 1/1008
9,774,945 B1 * 9/2017 Hoernschemeyer ... H04R 1/105
9,775,395 B2 10/2017 Teetzel et al.
9,778,453 B2 10/2017 Teetzel et al.
9,958,667 B2 * 5/2018 DiCarlo ..... F16M 11/041
D840,605 S * 2/2019 O'Connell ..... D29/122

(56) References Cited

U.S. PATENT DOCUMENTS 10,448,693 B2* 10/2019 Noordzij ..... A42B 3/225
10,638,807 B2* 5/2020 Long ..... A42B 3/003
10,765,165 B2* 9/2020 O'Connell ..... A42B 3/0406
2007/0067894 A1 3/2007 Bourree et al.
2007/0114252 A1 5/2007 Gruebel et al.
2008/0263752 A1 10/2008 Solinsky et al.
2009/0038056 A1 2/2009 Bobbin et al.
2009/0059063 A1 3/2009 Gallagher
2009/0135479 A1 5/2009 Soto et al.
2010/0012692 A1 1/2010 Harris
2010/0083413 A1* 4/2010 McGovern ..... A42B 3/04 2/6.6
2010/0091377 A1* 4/2010 Hedges ..... A42B 3/042 359/630
2010/0175172 A1 7/2010 Martin
2011/0072562 A1 3/2011 Prendergast
2011/0099695 A1 5/2011 Siviter
2011/0145981 A1 6/2011 Teetzel
2012/0120482 A1* 5/2012 Hedges ..... G02B 27/0176 359/353
2013/0031692 A1 2/2013 Wratten
2013/0291290 A1 11/2013 Bernier et al.
2014/0020159 A1 1/2014 Teetzel et al.
2014/0084120 A1 3/2014 Solinsky et al.
2014/0237708 A1 8/2014 DiCarlo
2014/0239138 A1* 8/2014 DiCarlo ..... F16M 13/02 248/274.1
2014/0239146 A1* 8/2014 DiCarlo ..... F16M 13/00 248/682
2014/0245523 A1* 9/2014 Teetzel ..... A42B 3/042 2/422
2014/0327962 A1 11/2014 Teetzel et al.
2014/0373423 A1 12/2014 Teetzel et al.
2014/0377011 A1* 12/2014 Yingling ..... E02D 7/06 405/232
2015/0002930 A1 1/2015 Teetzel et al.
2015/0026872 A1* 1/2015 Giroux Bernier ..... A42B 3/042 2/422
2015/0074878 A1 3/2015 Teetzel
2015/0089726 A1* 4/2015 Long ..... A42B 3/0406 2/422
2015/0107936 A1* 4/2015 Hein ..... A42B 3/163 181/284
2015/0138645 A1* 5/2015 Yoo ..... G02B 27/0149 359/630
2015/0223570 A1* 8/2015 Iten ..... A44B 11/125 24/68 J
2015/0264229 A1 9/2015 Teetzel et al.
2015/0282549 A1* 10/2015 Lebel ..... A42B 3/04 2/422
2015/0300781 A1* 10/2015 DiCarlo ..... F16M 13/02 42/111
2015/0351482 A1 12/2015 Gendron et al.
2016/0073023 A1* 3/2016 Rondinelli ..... G02B 7/02 348/36
2016/0088891 A1* 3/2016 Walsh ..... A42B 3/04 2/421
2016/0088892 A1* 3/2016 Sackett ..... A42B 3/127 2/414
2016/0097614 A1* 4/2016 Manly ..... F16B 21/186 42/90
2016/0191172 A1* 6/2016 Masarik ..... G02B 6/4212 361/679.01
2016/0381259 A1* 12/2016 Johnson ..... F16M 13/04 348/158
2017/0000207 A1* 1/2017 Hajianpour ..... A42B 3/044
2017/0027264 A1* 2/2017 Giroux Bernier ..... A42B 3/04
2017/0027267 A1 2/2017 Giroux Bernier
2017/0049176 A1 2/2017 Giroux Bernier et al.
2017/0064176 A1* 3/2017 Kim ..... F16M 11/041
2017/0112225 A1* 4/2017 Gotti ..... A42B 3/04
2017/0214998 A1* 7/2017 Hoernschemeyer ... H04R 1/105
2017/0257696 A1* 9/2017 Hoernschemeyer ..... A42B 3/30
2017/0302386 A1* 10/2017 Masarik ..... A42B 3/30
2017/0325534 A1* 11/2017 Noordzij ..... A42B 3/225
2018/0042330 A1* 2/2018 Wu ..... A42B 3/145
2018/0042774 A1* 2/2018 Wu ..... A61F 9/06
2018/0128459 A1* 5/2018 Carroll ..... F21L 4/04
2018/0284421 A1* 10/2018 DiCarlo ..... G02B 23/18
2018/0323675 A1* 11/2018 Wei ..... H02K 5/10
2019/0008227 A1* 1/2019 Vilone ..... F16B 2/22
2019/0101359 A1* 4/2019 Zimmer ..... A42B 3/30
2019/0380421 A1* 12/2019 Noordzij ..... A42B 3/223
2020/0000167 A1* 1/2020 Noordzij ..... A42B 3/042
2020/0077732 A1* 3/2020 O'Connell ..... A62B 18/084
2020/0113265 A1* 4/2020 Gehring ..... F41G 11/003
2020/0260811 A1* 8/2020 Long ..... A42B 3/0406
2020/0352269 A1* 11/2020 O'Connell ..... A42B 3/0406
2021/0030098 A1* 2/2021 O'Connell ..... A42B 1/24

FOREIGN PATENT DOCUMENTS

WO 2004090580 A2 10/2004
WO 2005000050 A2 1/2005
WO 2006084223 A2 8/2006
WO 2007002507 A2 1/2007
WO 2007002508 A2 1/2007
WO 2007070449 A2 6/2007
WO 2009045669 A2 4/2009
WO 2010129397 A1 11/2010
WO 2013192070 A1 12/2013
WO 2016049115 A1 3/2016

OTHER PUBLICATIONS

International Search Report dated May 31, 2018 for International Application No. PCT/US2018/022218, 2 pages.
Written Opinion dated May 31, 2018, for International Application No. PCT/US2018/022218, 5 pages.

* cited by examiner

MODULAR SHROUD

CROSS REFERENCE TO RELATED APPLICATIONS

This application is a 371 of International Application No. PCT/US2018/022218 filed on Mar. 13, 2018, which claims the benefit of U.S. Provisional Patent Application No. 62/470,716 filed Mar. 13, 2017 entitled "Modular Shroud", each of which is incorporated by reference herein in its entirety.

BACKGROUND OF THE INVENTION

The present invention relates to an accessory mounting device and, more particularly, to a modular shroud coupled to a helmet.

Helmets may be worn for protection in a variety of settings including recreational use such as rock climbing or used in industry such as by military, firefighter, construction, manufacturing, or police personnel. It is sometimes desirable to have an accessory mounted to the helmet such as a pair of night vision goggles (NVG), camera, face shield, light, battery, or mask. Traditional helmet systems do not offer many options for attaching an accessory to a helmet. Accessories attached with adhesive may become dislodged from the helmet. Accessories that are mounted with anchors such as screws may require holes to be drilled into the helmet which can detrimentally affect the structural integrity of the helmet and/or require tools to mount and detach the accessories which may be impractical in certain situations.

An improved shroud for attaching a variety of accessories is desired.

BRIEF SUMMARY OF THE INVENTION

In one embodiment, a modular shroud system may comprise a shroud configured to be coupled to a helmet and a plate configured to be detachably coupled to the shroud while the shroud is coupled to the helmet. The modular shroud system may include a coupling element configured to at least temporarily secure the plate to the shroud. The coupling element may comprise a threaded fastener configured to engage an opening in at least one of the plate and the shroud. The plate may be configured to be coupled to an accessory device. The plate may be one of a plurality of plates and the shroud may be configured to receive any of the plurality of plates. The plate may include a first engagement feature configured to be coupled to the accessory device. Another of the plurality of plates may include a second engagement feature and the second engagement feature may be different than the first engagement feature. The plate may be a universal mount plate and another of the plurality of plates may be a rail plate. The shroud may include a rail configured to overlap at least a portion of the plate when the plate may be coupled to the shroud.

The plate may include an engagement portion configured to engage the rail. The engagement portion may include at least one of a chamfer and a radius. The plate may include a tongue and the shroud may include a recess configured to receive the tongue. The shroud may include a shroud upper surface and the plate may include a plate upper surface configured to be co-planar with the shroud upper surface when the plate may be coupled to the shroud. The shroud may include a ledge configured to be adjacent a rear surface of the plate. The ledge may be discontinuous.

In a further embodiment, the modular shroud system may comprise an accessory device configured to be coupled to the plate. The accessory device may comprise at least one of night vision goggles, a camera, and a light. The shroud may include a groove configured to receive a leash coupled to an accessory device. In a further embodiment, the modular shroud system may include a leash coupled to an accessory device, wherein the leash may comprise a bungee. The shroud may include a sidewall defining a receiving area for the plate. The sidewall may include a chamfered corner.

In another embodiment a modular shroud system may include a shroud configured to be coupled to a helmet, a first plate, and a second plate. The first plate may include a recess configured to receive a portion of a shoe connected to an accessory device. The second plate may include a rail configured to couple to a shoe connected to an accessory device. Each of the first plate and the second plate may be configured to be detachably coupled to the shroud while the shroud is coupled to the helmet.

BRIEF DESCRIPTION OF THE SEVERAL VIEWS OF THE DRAWINGS

The following detailed description of embodiments of the modular shroud will be better understood when read in conjunction with the appended drawings of an exemplary embodiment. It should be understood, however, that the invention is not limited to the precise arrangements and instrumentalities shown. For example, although not expressly stated herein, features of one or more various disclosed embodiments may be incorporated into other of the disclosed embodiments.

In the drawings.

DETAILED DESCRIPTION OF THE INVENTION

Figure 1:
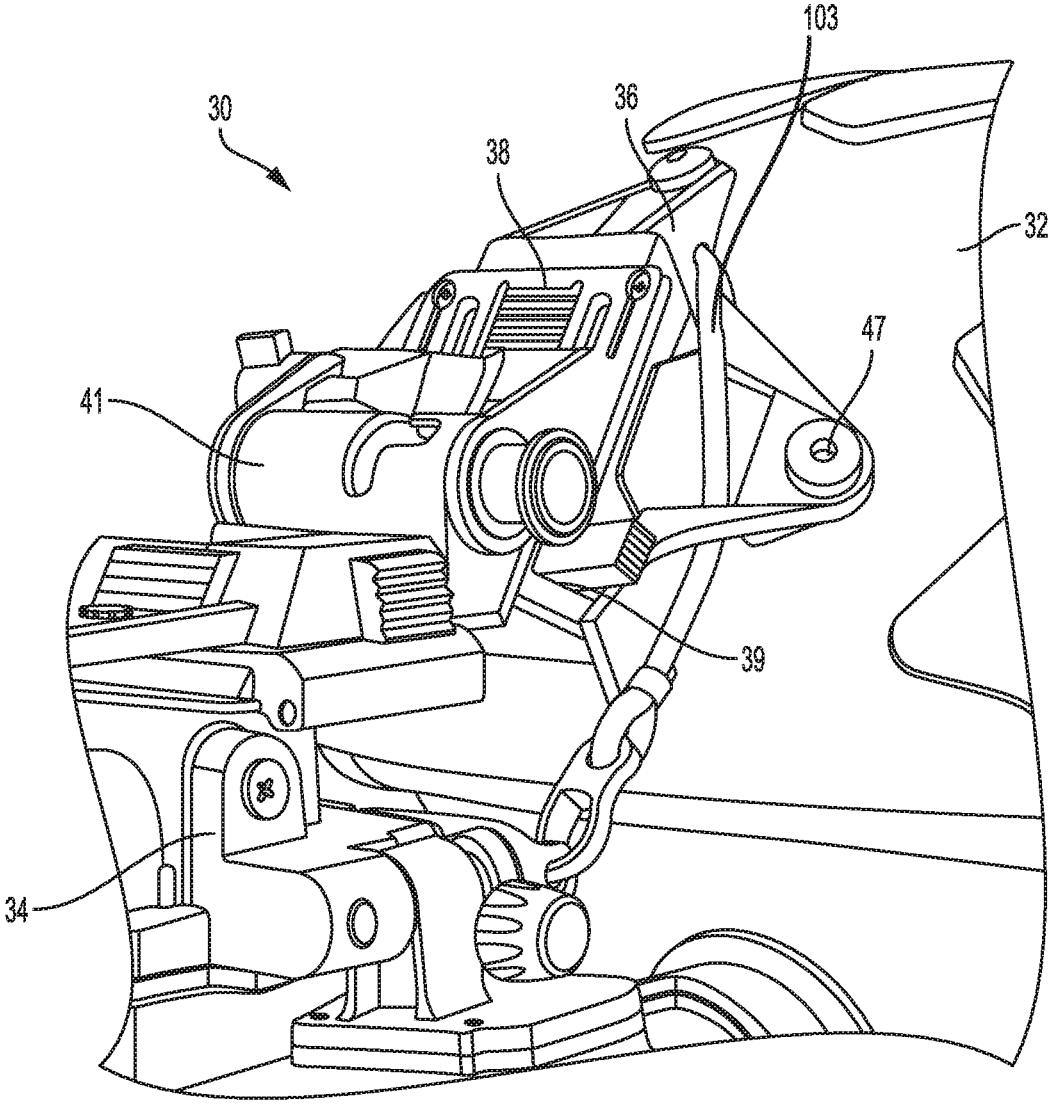
FIG. 1 is a front perspective view of a modular shroud system with an attached accessory device in a use position in accordance with an exemplary embodiment of the present invention.

Referring to the drawings in detail, wherein like reference numerals indicate like elements throughout, there is shown in FIGS. 1-6 a modular shroud system, generally designated 30, in accordance with an exemplary embodiment of the present invention.

Figure 2:
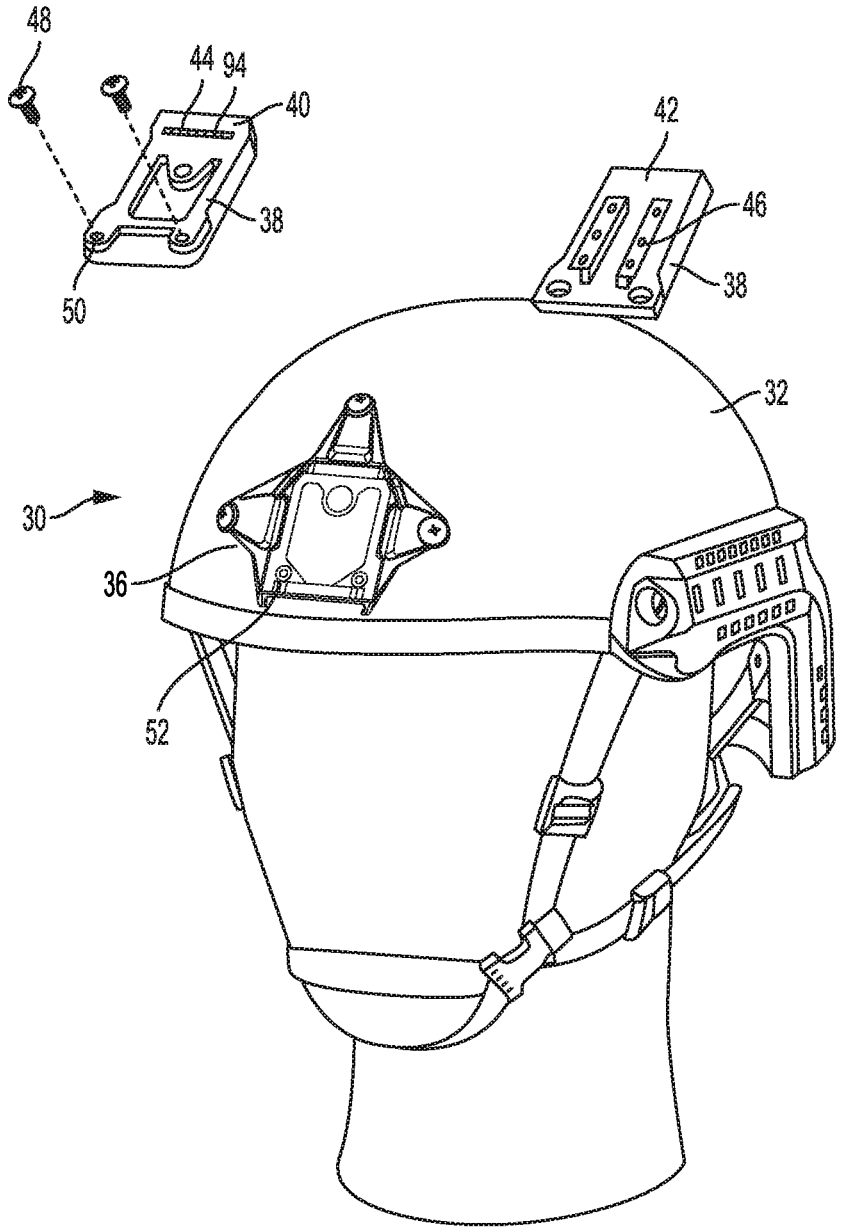
FIG. 2 is a front, perspective, exploded view of the modular shroud system of FIG. 1.
Figure 3:
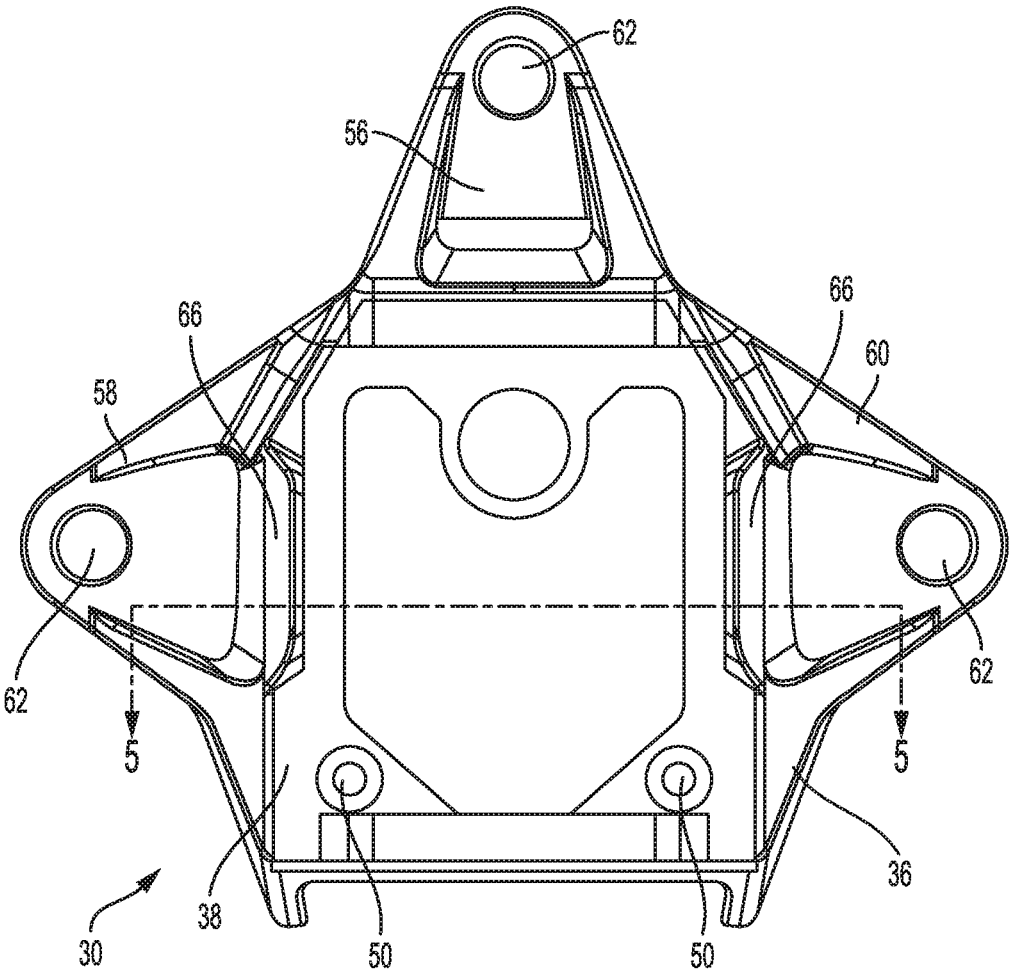
FIG. 3 is a front elevational view of the modular shroud system of FIG. 1.

Referring to FIGS. 1-2, the modular shroud system 30 may be configured to selectively secure one or more accessory devices 34 to a helmet 32 quickly and easily without the use of tools. The modular shroud system 30 may be configured to allow a user to attach and detach an accessory device 34 from the helmet 32 while the helmet 32 is on the user's head. The accessory device 34 may be, for example but not limited to, a night vision goggle (NVG), binoculars, a light, a telescope, helmet mounted displays, visors, maxillofacial or mandible shields, thermal sight, and/or a camera. The modular shroud system 30 may include a shroud 36 configured to be attached to the helmet 32. The shroud includes a plate 38 that is configured to releaseably couple to a corresponding feature of the accessory device 34. The accessory device 34 may be moveable with respect to the shroud 36 while coupled to the shroud 36 between a stowed position and a use position.

Referring to FIGS. 1-2, the plate 38 may be detachably coupled to the shroud 36 while the shroud is coupled to the helmet 32. The plate 38 may be attached and/or detached from a front facing surface of the shroud 36 (i.e., the direction that accessory devices mounts or detaches from the shroud 36). The plate 38 may be coupled to the shroud 36 by a fastener 48. The fastener 48 may be a bolt, screw, dowel, snap fit, expanding anchor, or magnet. In one embodiment, the plate 38 includes a plate opening 50 configured to align with a pre-existing shroud opening 52. There are two shroud openings 52 shown in FIG. 2, one in each lower corner of the shroud 36, however, any number of shroud openings could be implemented (e.g. one in each corner). The shroud opening 52 may be threaded to receive a threaded bolt or screw. The plate 38 may be one of a plurality of plates configured for mounting different accessory devices 34 and the shroud 36 may be configured to interchangeably receive any of the plurality of plates while the shroud 36 is coupled to the helmet 32. The plurality of plates may include a first plate 40 and a second plate 42. The first plate 40 may include a first engagement feature 44 and the second plate 42 may include a second engagement feature 46. The first engagement feature 44 may be different than the second engagement feature 46. The first engagement feature 44 and/or the second engagement feature 46 may be selected from a rail, a slot, a track, a bar, and a protuberance. At least one of the first plate 40 and the second plate 42 may be a universal square plate, as described in greater detail below. The other of the first plate 40 and the second plate 42 may be a rail plate. The rail plate may include a rail 49 that extends above a surface of the plate 38. The rail 49 may engage a groove in a shoe coupled to the accessory device. The rail 49 may include openings 51 configured to receive a fastener (e.g., a threaded connector such as a bolt or screw) to couple the shoe on the accessory device to the rail 49.

In some embodiments, the different accessory devices 34 are configured to engage a plate having differing engagement features and a detachable plate 38 allows such different accessory devices to be coupled to the helmet 32 without detaching the shroud 36 from the helmet. The shroud 36 may be configured to be positioned on a front portion of the helmet 32. The accessory device 34 may be positioned in front of a user's face or eyes in the use position.

Referring to FIGS. 3-6, the shroud 36 may include a body 54. The shroud 36 may include a crown 56, a first wing 58, and a second wing 60 coupled to the body 54. The first wing 58 and the second wing 60 may be on opposing sides of the shroud 36. In one embodiment, each of the crown 56, first wing 58, and second wing 60 include an aperture 62 configured to receive a fastener 47 (see FIG. 1). The fastener 47 may be a screw, bolt, rivet, nail, weld, or heat stake. The fastener 47 may be coupled to the helmet 32 using existing bolt holes. The aperture 62 may be threaded to receive a threaded fastener. The apertures 62 may be arranged to follow a bolt pattern on the helmet 32. In other embodiments, the shroud 36 may be permanently affixed to the helmet 34 and the plate 38 may be detachably coupled to the permanently affixed shroud. In still other embodiments, the shroud 36 and the helmet 32 may be a unitary construct. A first side 64 of the shroud 36 may be defined by a radius of curvature (best seen in FIG. 5) configured to approximate an outer radius of a helmet 32. The shroud 36 may be flexible such that the shroud 36 can adapt to the exterior surface of a selected helmet or other structure which the shroud 36 is coupled to. The shroud 36 may include a first opening or the aperture 62 configured to receive the fastener 47 and a second opening or the shroud opening 52 configured to receive the fastener 48.

Figure 4:
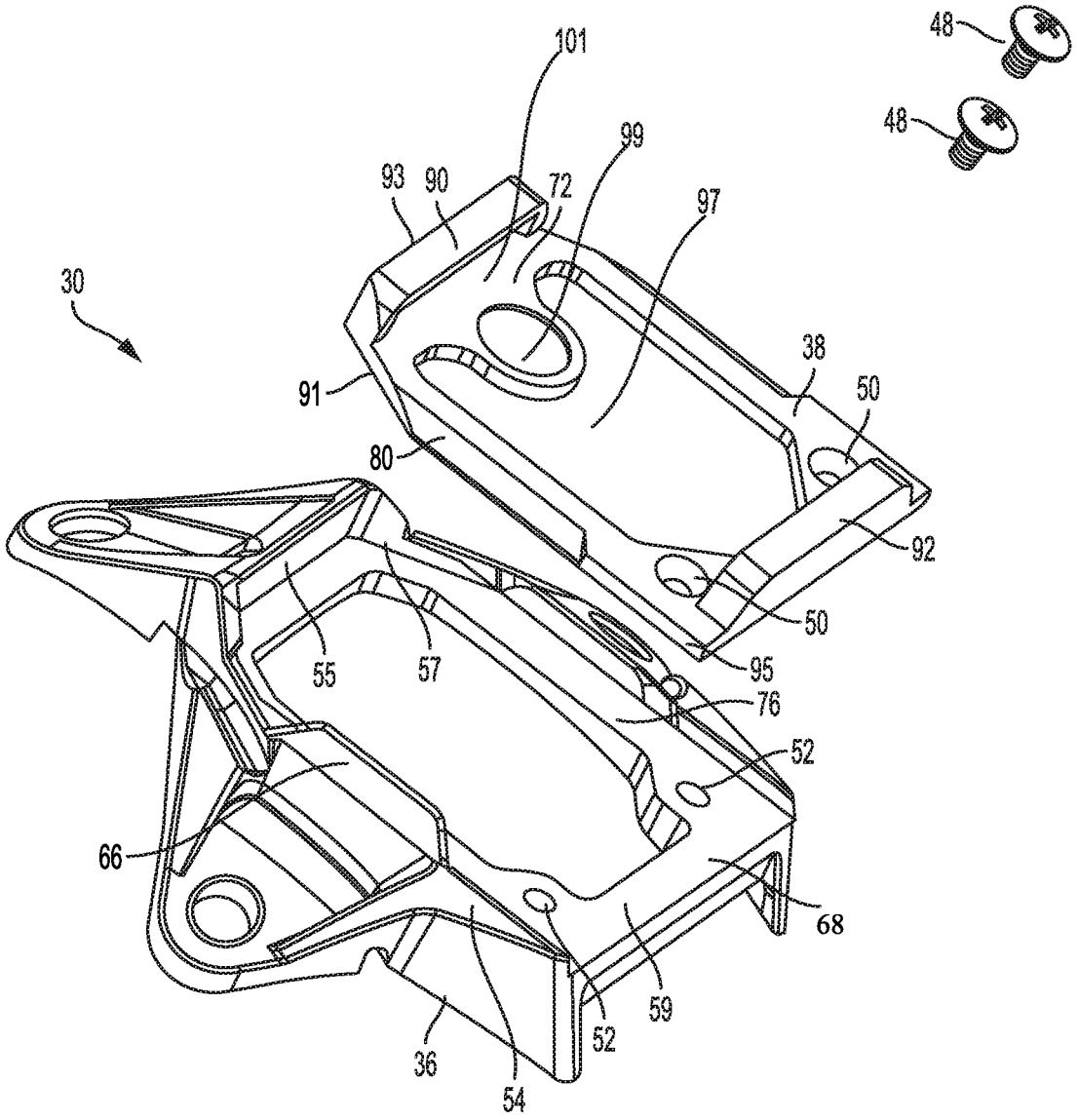
FIG. 4 is a side, perspective, exploded view of the modular shroud system of FIG. 1.

Referring to FIGS. 3-6, the plate 38 may be adjacent the body 54 when the plate 38 is coupled to the shroud 36. The body 54 may include a ledge 68 configured to be adjacent a rear surface 74 of the plate when the plate 38 is coupled to the shroud 36. In one embodiment, the ledge 68 contacts the rear surface 74 of the plate 38 when the plate 38 is coupled to the shroud 36. The body 54 may include a sidewall 55 extending outwardly away from the ledge 68 (FIG. 4). The sidewall 55 may define a receiving area for the plate 38. The sidewall 55 may have a perimeter shape similar to a perimeter shape of the plate 38. In one embodiment, the plate may have a length of about 40 millimeters to about 80 millimeters, about 50 millimeters to about 70 millimeters, or about 60 millimeters. In one embodiment, the plate 38 may have a width of about 30 millimeters to about 70 millimeters, about 40 millimeters to about 60 millimeters, or about 50 millimeters. In one embodiment, the sidewall 55 at least partially borders or is adjacent to a portion of the plate 38 when the plate 38 is coupled to the shroud 36. The sidewall 55 may include a chamfered corner 57. In other embodiments, the corner 57 may include a radius. The sidewall 55 may extend along more than one side of the plate 38 when the plate 38 is coupled to the shroud 36. The sidewall 55 may be discontinuous. In one embodiment, the sidewall 55 may include a sidewall gap 59 such that the plate 38 may be moved through the sidewall gap 59 into engagement with the sidewall 55 and ledge 68. The sidewall 55 may define an open ended rectangular receiving area with a chamfered corner 57.

Referring to FIGS. 3-6, the body 54 may include a rail 66 configured to at least partially secure the plate 38 to the shroud 36. The ledge 68 may include a surface 76 and at least a portion of the rail 66 may be spaced from ledge surface 76. The rail 66 and the surface 76 may define a space 78 configured to receive at least a portion of the plate 38. The plate 38 may include an engagement portion 80 configured to be positioned within the space 78 between the rail 66 and the surface 76. The engagement portion 80 may include a chamfered edge at an angle of about 30° to about 60°, about 40° to about 50°, or about 45°.

In 2 millimeters to about 5 millimeters. The chamfered face of the engagement portion 80 may have a length of about 20 millimeters to about 30 millimeters. In other embodiments, the engagement portion 80 may include a fillet or a section of the plate 38 having a reduced thickness. The engagement portion 80 and the space 78 may have similar cross-sectional shapes to securely couple the plate 38 to the body 54 (cross-section of shroud 36 best seen in FIG. 5). In one embodiment, the engagement portion 80 is shaped and configured to form a sliding dovetail joint with space 78. The rail 66 may overlap a portion of the plate 38 when the plate 38 is engaged with the shroud 36.

In one embodiment the plate 38 engages the body 54 by sliding the plate 38 along the surface 76 until the engagement portion 80 engages or aligns with the rail 66. In one embodiment, the rail 66 secures the plate 38 to the shroud 36 and the fasteners 48 prevent relative movement between the rail 66 and the plate 38. In another embodiment, at least one of the rail 66 and the engagement portion 80 are moveable such that the plate 38 is snap-fit into engagement with the rail 66. In another embodiment, the body 54 does not include a rail 66 and the plate 38 is positioned on the ledge surface 76 and secured by fastener 48. In some embodiments, plate 38 is slid through sidewall gap 59.

Figure 5:
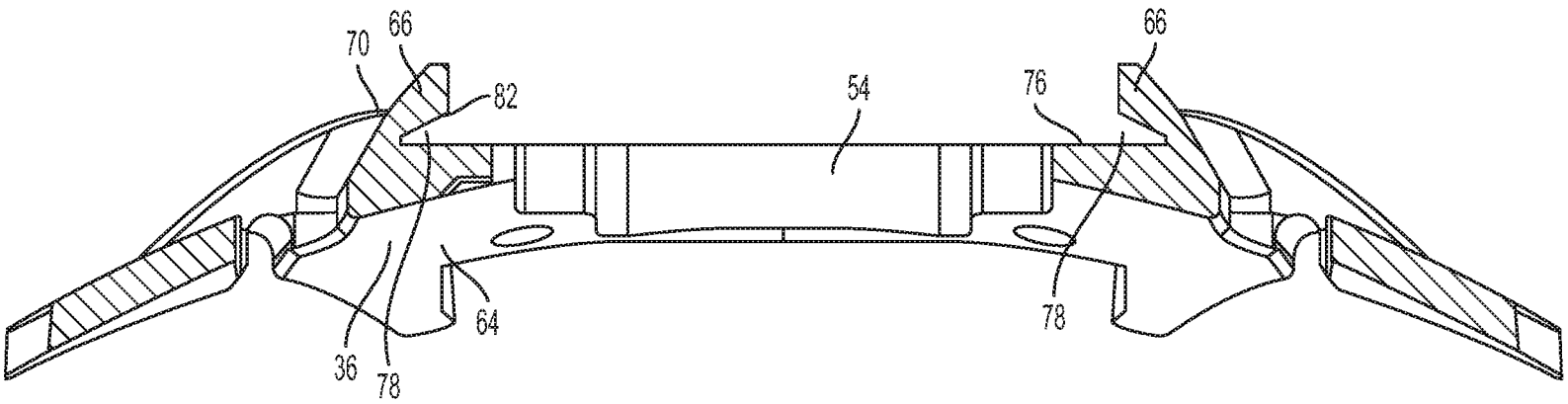
FIG. 5 is a top perspective, sectional view of the shroud of FIG. 1 along line 5-5 of FIG. 3.
Figure 6:
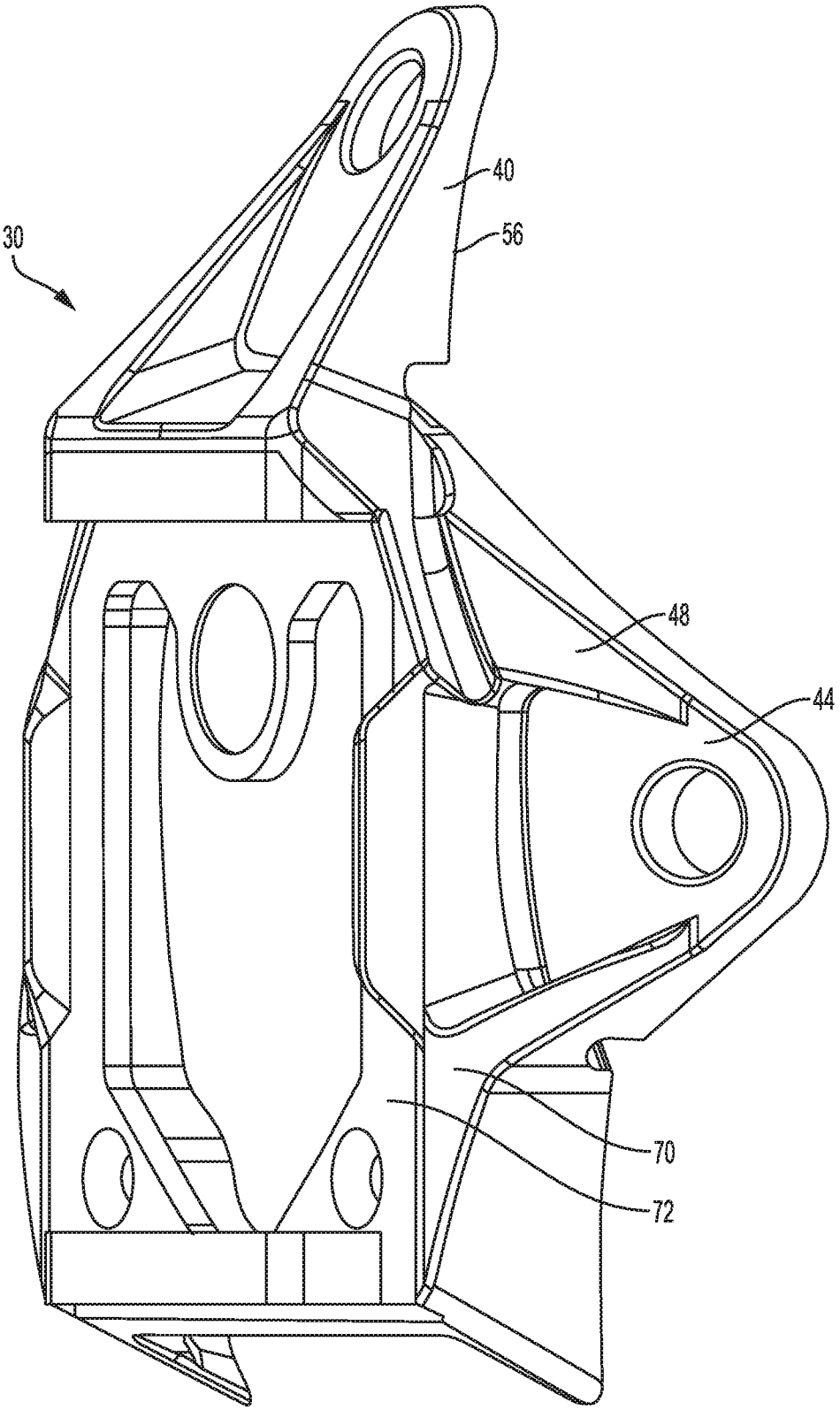
FIG. 6 is a side, perspective view of the modular shroud system of FIG. 1.
Figure 7:
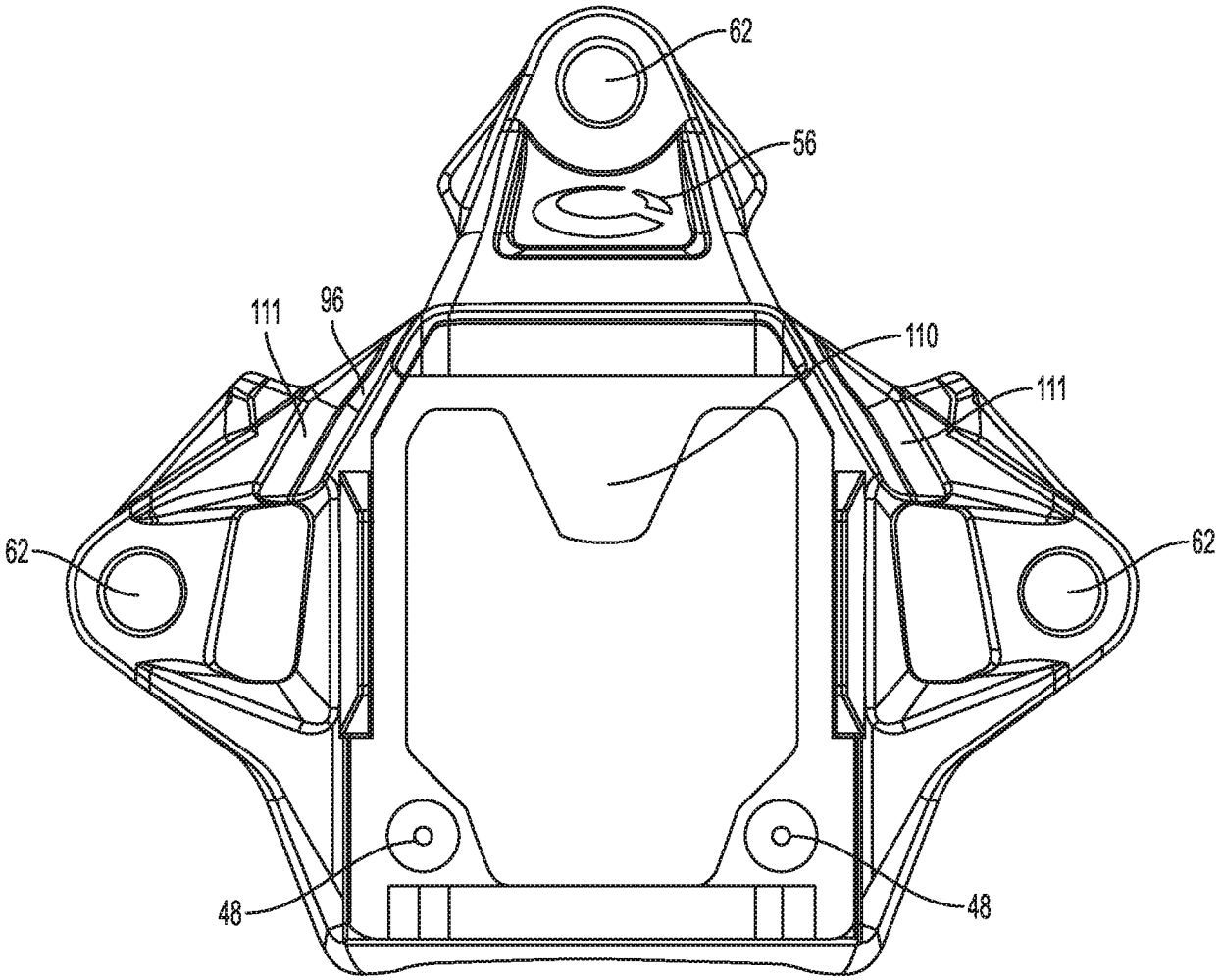
FIG. 7 is a front elevational view of a modular shroud system in accordance with another exemplary embodiment of the present invention.
Figure 8:
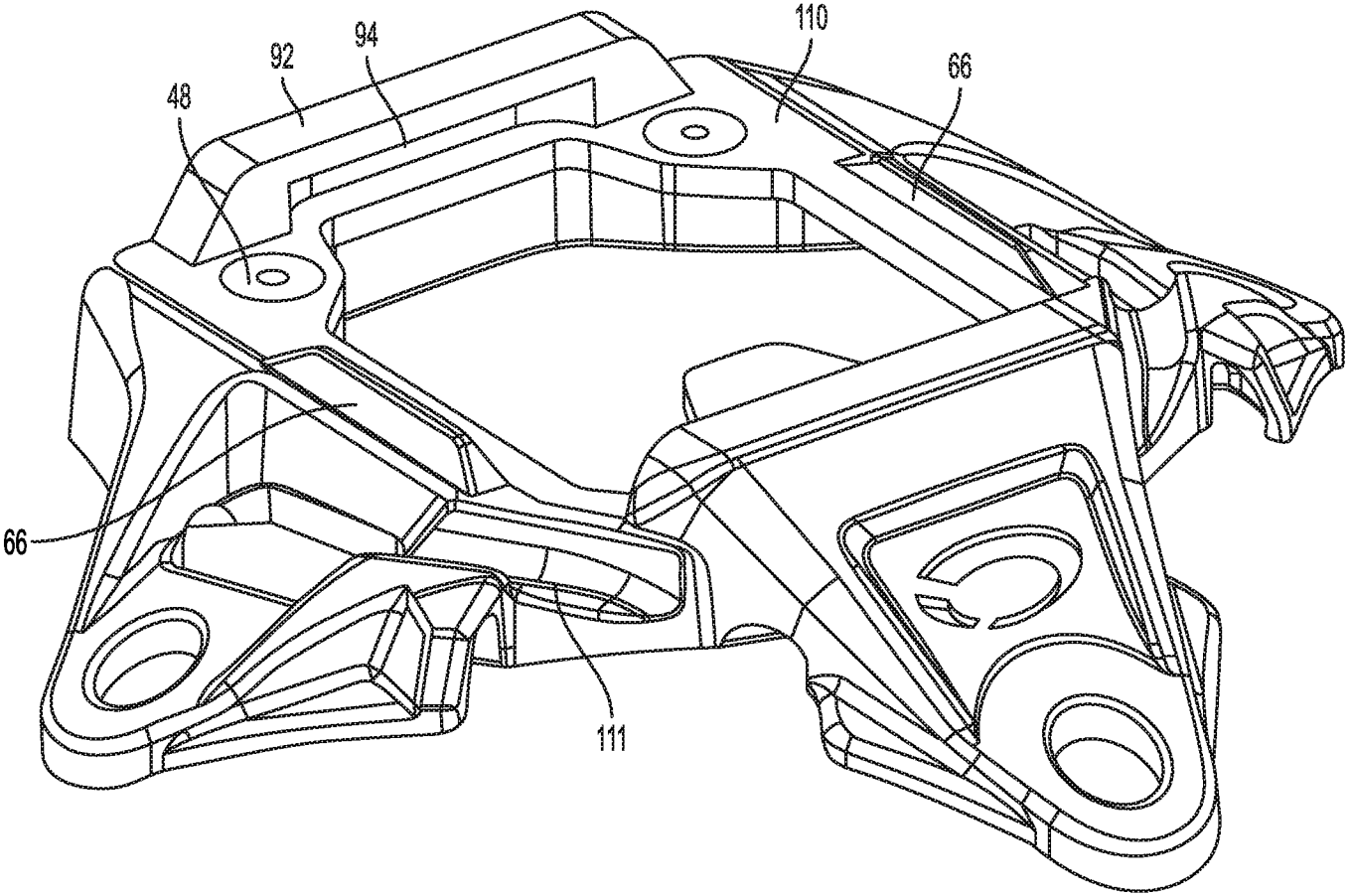
FIG. 8 is a front, side perspective view of the shroud of FIG. 7.

The body 54 of the shroud 36 may include a second side or upper surface 70 (FIG. 5). The sidewall 55 may extend between the upper surface 70 and the ledge surface 76. The plate 38 may include an upper surface 72. In one embodiment, the shroud upper surface 70 and the plate upper surface 72 may be co-planar when the plate 38 is coupled to the shroud 36. The rail 66 may include a lower surface 82 (FIG. 5). At least a portion of the lower surface 82 of the rail 66 may be positioned above the upper surface 70 of the shroud 36. In other embodiments, the lower surface 82 and the upper surface 70 are co-planar. The lower surface 82 may be defined by a plane transverse to the ledge surface 76.

The plate 38 may include a corner feature 91. The corner feature 91 may be a chamfer or a fillet. The corner feature 91 may abut the engagement feature 80. In one embodiment, the corner feature 91 includes a first chamfer and the engagement feature 80 includes a second chamfer. The first chamfer may extend from a front wall 93 to a sidewall 95 of the plate 38. The second chamfer may extend from the sidewall 95 to the plate upper surface 72. The first chamfer and the second chamfer may be transverse to each other.

Turning to FIGS. 1 and 4, the plate 38 may be a universal square plate and include a first overhang 90 and a second overhang 92. The first overhang 90 and the second overhang 92 may each include a recess 94 configured to receive a portion of a shoe 39. The plate 38 may include an internal opening 97. The internal opening 97 may extend through the plate 38. The plate 38 may include a protrusion 99 that extends into the internal opening 97 from an upper region 101 of the plate 38 toward the second overhang 92. The protrusion 99 may be a semi-spherical protrusion. The shape of the protrusion 99 may be selected to be complementary to the shoe 39.

The shoe 39 may include a latch or a retractable engagement feature such that the shoe 39 can be detachably coupled to the first overhang 90 and the second overhang 92 while the plate 38 and shroud 36 are coupled to the helmet. The shoe 39 may be configured to be coupled to a accessory device arm 41. The accessory device arm 41 may be configured to be attached to the accessory device 34. The accessory device 34 may be coupled to the helmet 32 such that an order of coupling elements includes the helmet 32, the shroud 36, the plate 38, the shoe 39, the accessory device mounting arm 41 and the accessory device 34.

Figure 9:
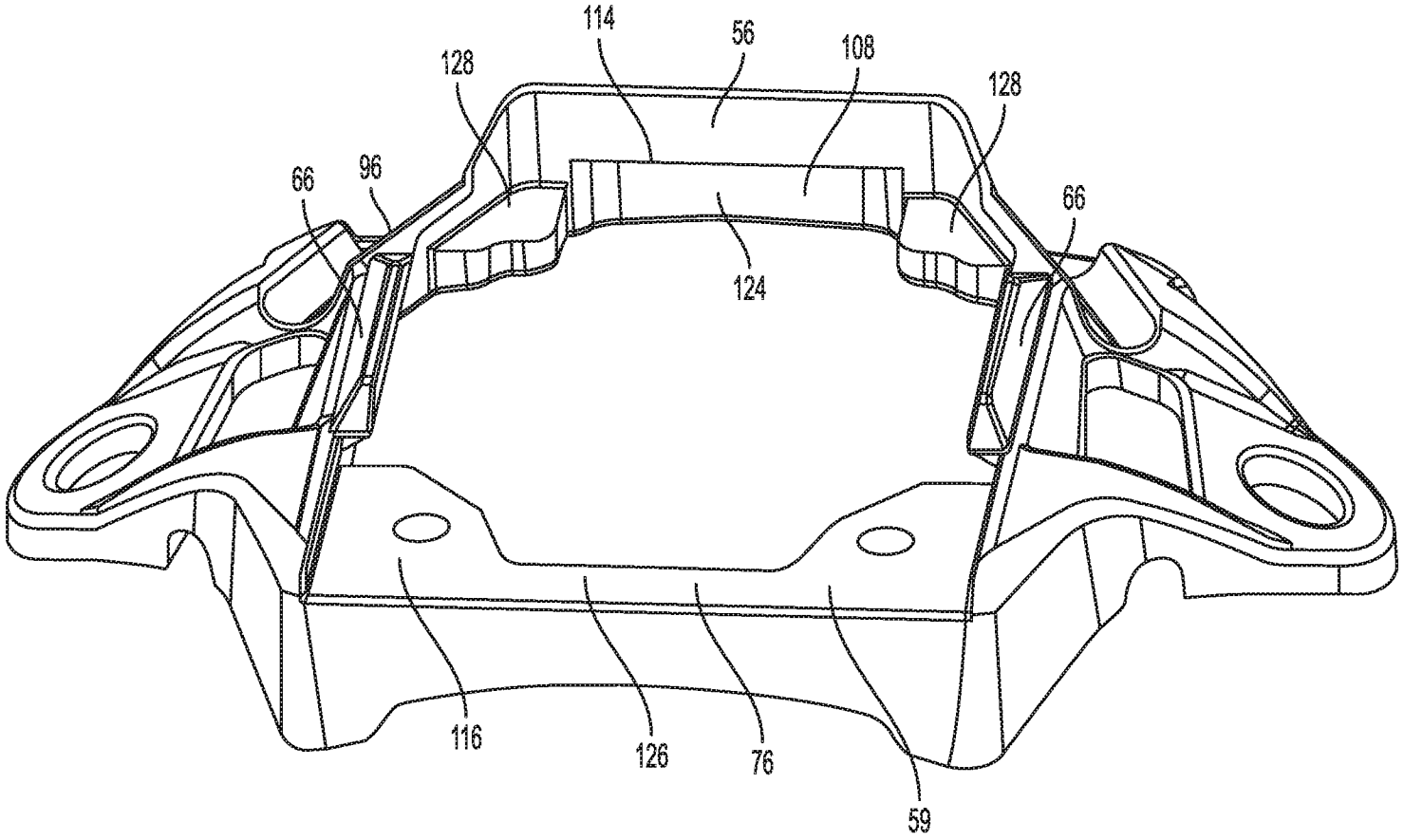
FIG. 9 is a front, bottom perspective view of the shroud of FIG. 7.
Figure 10:
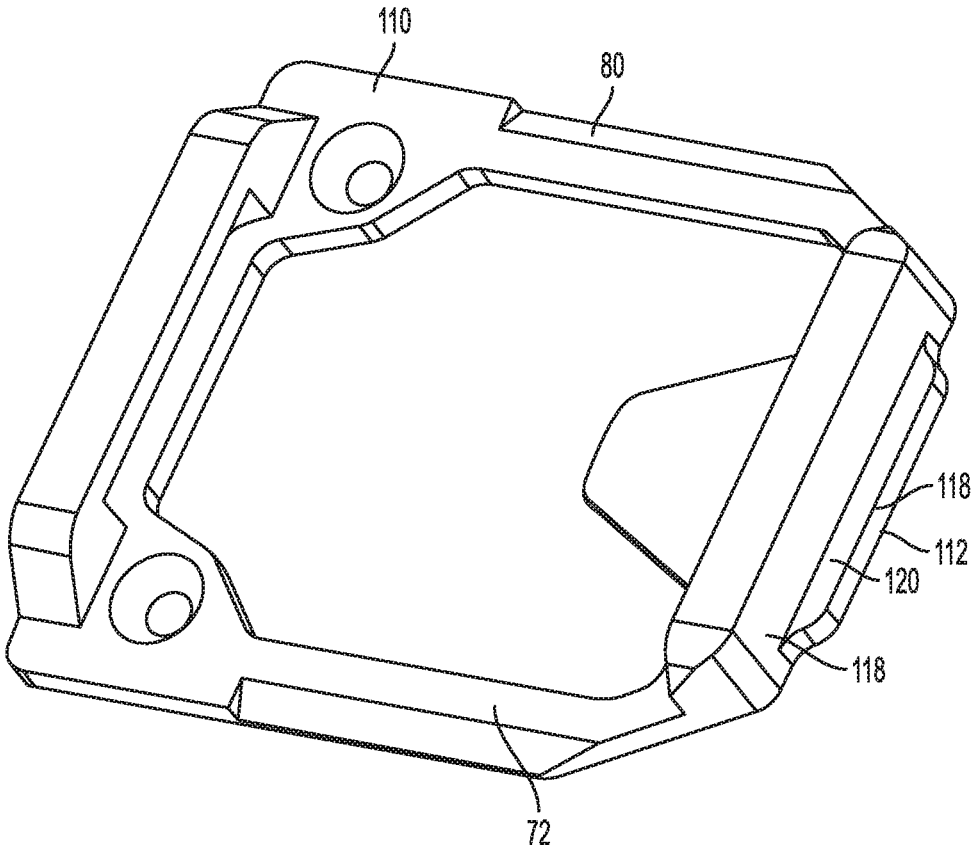
FIG. 10 is a front, side perspective view of the plate of FIG. 7.
Figure 11:
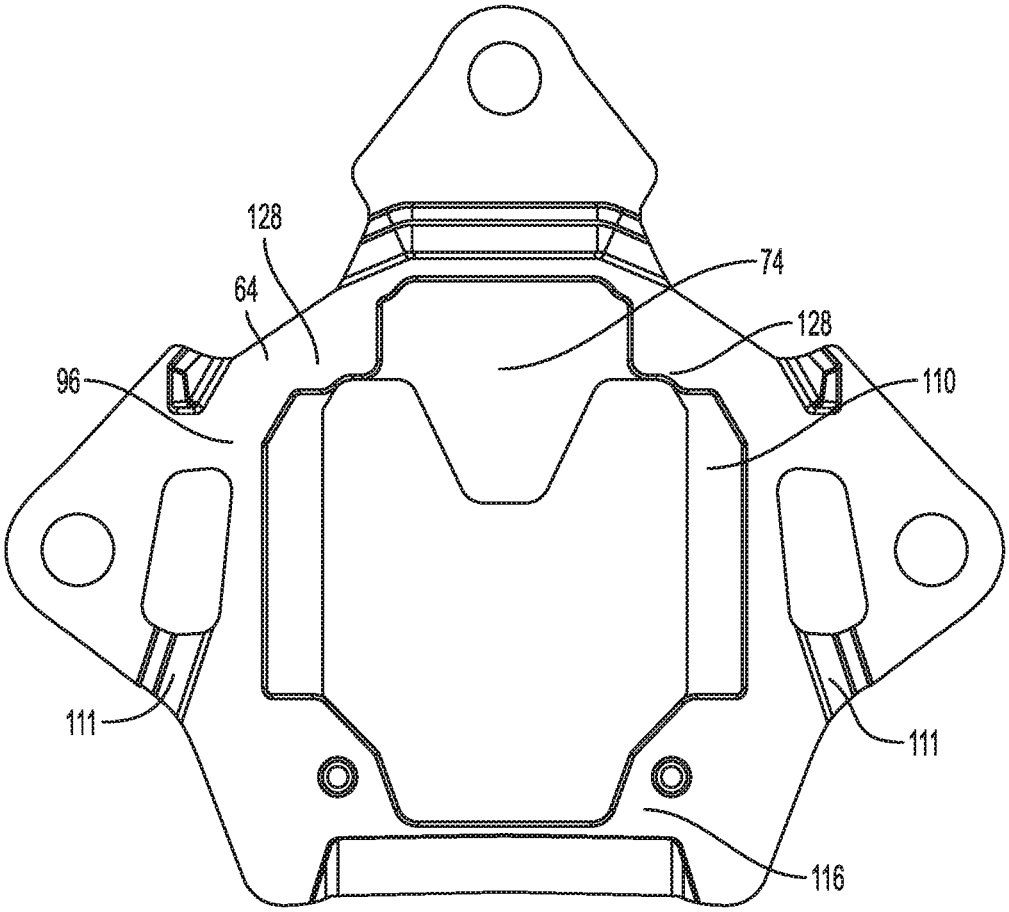
FIG. 11 is a rear elevational view of the modular shroud system of FIG. 7.
Figure 12:
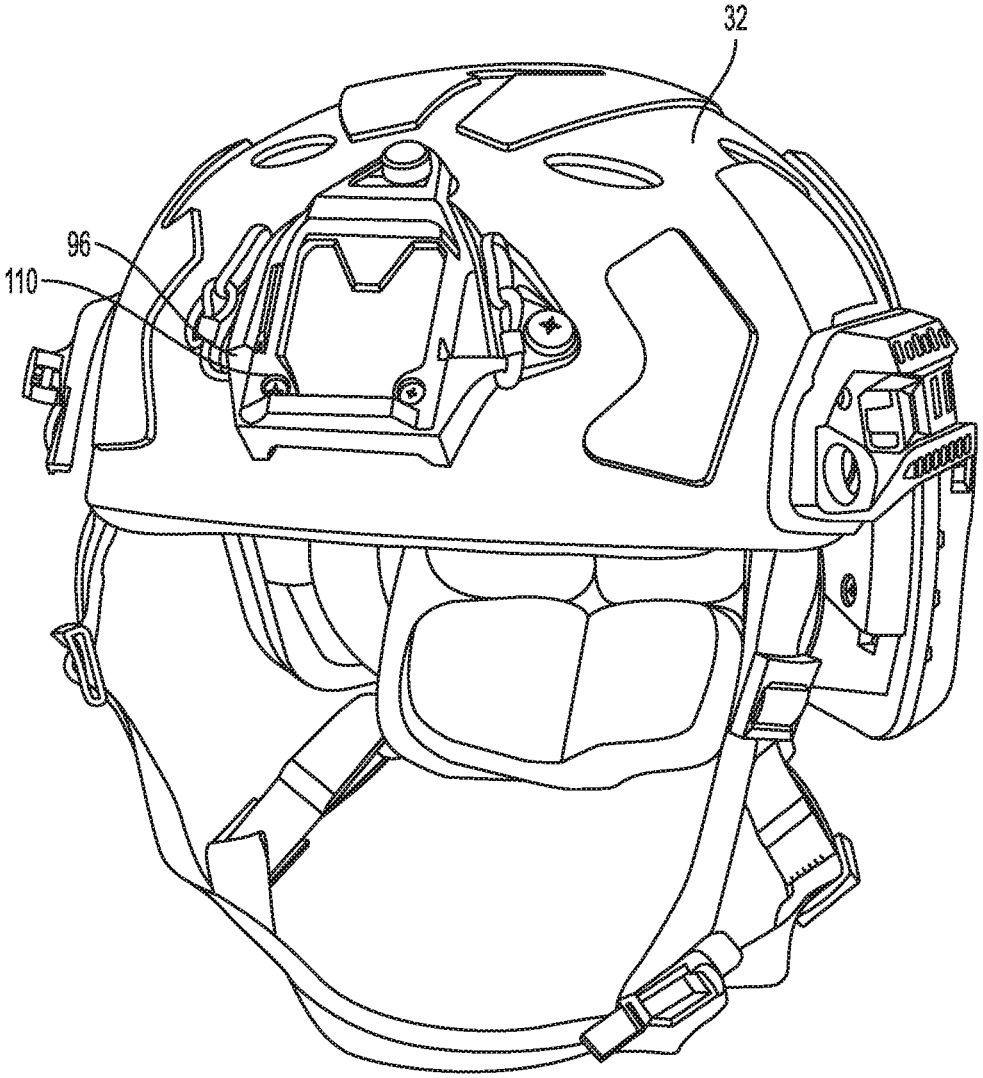
FIG. 12 is a front, perspective view of the modular shroud system of FIG. 7 coupled to a helmet.

Referring to FIGS. 7-12, there is shown another embodiment of a shroud 96. The shroud 96 may be similar to the previously described embodiment of the shroud 36 as both may be configured to detachably receive the plate 38 while the shroud 96 is coupled to the helmet 34. The crown 56 of shroud 96 may include a recess 108 configured to receive a portion of a plate 110 (FIG. 9). In one embodiment, the dimensions of the recess 108 are about 1 millimeter to about 5 millimeters by about 1 millimeter to about 5 millimeters by about 10 millimeters to about 30 millimeters. In one embodiment, the dimensions of the recess 108 are about 2 millimeters by about 2 millimeters by about 20 millimeters.

The shroud 96 may include a ledge 116 and the recess 108 may extend above the surface 76 of the ledge 116. The recess 108 may be open to a first side 64 of the shroud 96. The first side 64 may be adjacent the helmet 32 when the shroud 96 is coupled to the helmet 32. The plate 110 may include a tongue 112 configured to be positioned within the recess 108 when the plate 110 is coupled to the shroud 96. The tongue 112 may extend from a front wall 118 of the plate 110. An upper surface 120 of the tongue 112 may be coplanar with the plate upper surface 72. The shroud 96 may include a rim 114 bordering the recess 108 and configured to prevent the tongue 112 from disengaging from the recess 108. The upper surface 120 of the tongue 112 may be configured to be adjacent or abut the lower surface of the rim 114. A front wall 122 of the tongue 112 may be adjacent to or abut a front wall 124 of the recess 108 when the plate 110 is coupled to the shroud 96.

The ledge 116 may be discontinuous. The ledge 116 may include a first portion 126 spaced from a second portion 128. The first portion 126 may be positioned adjacent the sidewall gap 59. The second portion 128 may be positioned adjacent the recess 108. The first portion 126 may be spaced from the second portion 128 such that the ledge 116 is not positioned below the rail 66. In one embodiment, a discontinuous ledge may reduce the weight of the shroud 96 compared to a shroud with a continuous ledge. The shroud 96 may include one or more grooves 111 configured to receive a leash 103 (e.g., a rope or bungee) coupled to the accessory device (leash 103 best seen in FIG. 1). The groove 111 may be formed in the front surface, the rear surface, or both the front and rear surfaces of the shroud 96. The sides and ends of the groove 111 may include a chamfer or radius at the edge to reduce wear on the leash 103.

At least one of shroud 36 and shroud 96 may be included in a kit. A method of retrofitting the shroud 36 onto a helmet may include removing an existing shroud from the helmet. The method may include coupling the shroud 36 to the helmet using an existing bolt pattern. The method may include couple one of a plurality of plates 38 to the shroud 36. The method may include removing one plate 38 from the shroud 36 and coupling another plate 38 to the shroud 36 without removing the shroud 36 from the helmet.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower" and "upper" designate directions in the drawings to which reference is made. The words "inwardly" and "outwardly" refer to directions toward and away from, respectively, the geometric center of the modular shroud system. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

We claim:

1. A modular shroud system comprising:

a shroud configured to be coupled to a helmet; and a plurality of plates including a first plate having a first mounting feature and a second plate having a second mounting feature different than the first mounting feature, each of the plurality of plates being configured to be separately and directly detachably coupled to the shroud, wherein each of the first plate and the second plate is configured to be attached to and detached from the shroud while the shroud is coupled to the helmet, wherein the first mounting feature and the second mounting feature are each configured to couple a corresponding accessory device to the helmet, wherein the shroud includes a rail configured to extend over a top surface of at least a portion of a plate of the plurality of plates when the plate is coupled to the shroud, the rail configured to at least partially secure the plate to the shroud, and wherein each of the plurality of plates are configured to be directly detachably coupled to the rail of the shroud.

2. The modular shroud system of claim 1 further comprising:

a coupling element configured to at least temporarily secure each of the plurality of plates to the shroud.

3. The modular shroud system of claim 2, wherein the shroud includes a threaded aperture and the coupling element comprises a threaded fastener extending through each of the plurality of plates into the threaded aperture of the shroud.

4. The modular shroud system of claim 1, wherein the first plate is a universal mount plate and the second plate is a rail plate.

5. The modular shroud system of claim 1, wherein the rail is a first rail and the shroud includes a second rail parallel to the first rail, and wherein each of the plurality of plates includes a first chamfered side edge configured to snap fit under the first rail, and a second chamfered side edge configured to snap fit under the second rail when each of the plurality of plates is secured to the shroud.

6. The modular shroud system of claim 1, wherein each of the plurality of plates includes a front wall, an upper surface, and a tongue extending from the front wall and coplanar with the upper surface, and the shroud includes a recess configured to receive the tongue.

7. The modular shroud system of claim 1, wherein the shroud includes a shroud upper surface and each of the plurality of plates includes a plate upper surface configured to be co-planar with the shroud upper surface when the each of the plurality of plates is coupled to the shroud.

8. The modular shroud system of claim 1, wherein the shroud includes a discontinuous ledge having a first portion spaced apart from a second portion, the discontinuous ledge being configured to be adjacent a rear surface of each of the plurality of plates.

9. The modular shroud system of claim 1 further comprising: a plurality of accessory devices each corresponding to each of the plurality of plates wherein the plurality of accessory devices comprises at least one of night vision goggles, a camera, and a light.

10. The modular shroud system of claim 1, wherein the shroud includes a groove configured to receive a leash coupled to an accessory device.

11. The modular shroud system of claim 10, further comprising a leash coupled to an accessory device, wherein the leash comprises a bungee.

12. The modular shroud system of claim 1, wherein the shroud includes a plurality of apertures for securing the shroud to the helmet.

13. The modular shroud system of claim 12, wherein the plurality of apertures are arranged in a triangular configuration.

14. The modular shroud system of claim 12, wherein the plurality of apertures are each disposed on a wing, each wing extending away from each of the plurality of plates when each of the plurality of plates is coupled to the shroud.

15. The modular shroud system of claim 14, wherein each wing is substantially triangular in shape.

16. The modular shroud system of claim 1, wherein the shroud includes a recessed mounting area having a top end, a bottom end opposite the top end, a top rail proximate the top end, and two threaded apertures proximate the bottom end and opposite the top rail, the two threaded apertures each configured to receive a fastener to secure each of the plurality of plates to the shroud.

17. The modular shroud system of claim 1, wherein when the shroud is coupled to the helmet each plate of the plurality of plates is coupled to the helmet only indirectly by at least one fastener releasably coupling the plate to the shroud.

18. The modular shroud system of claim 1, wherein the first mounting feature includes a recess configured to receive a square shoe portion of a corresponding accessory device and the second mounting feature includes a rail extending above a surface of the second plate, the rail being configured to engage a groove shoe portion of a corresponding accessory device.

19. A helmet system comprising:

a helmet having an exterior surface;

a modular shroud system comprising:

a shroud configured to be coupled to a helmet; and a plurality of plates including a first plate having a first mounting feature and a second plate having a second mounting feature different than the first mounting feature, each of the plurality of plates being configured to be separately and directly detachably coupled to the shroud, wherein each of the first plate and the second plate is configured to be attached to and detached from the shroud while the shroud is coupled to the helmet, wherein:

the shroud is coupled to the exterior surface of the helmet, the shroud having a recess and three apertures;

three shroud fasteners configured to secure the shroud to the exterior surface of the helmet, each fastener extending through one of the three apertures of the shroud and into the helmet; and the first plate having a recess configured to receive a square portion of a first shoe connected to a first accessory device and the second plate including a mounting rail extending from a surface of the second plate, the mounting rail configured to engage a groove portion of a second shoe connected to a second accessory device, each of the plurality of plates having at least two apertures configured to receive a plate fastener to secure each of the plurality of plates to the shroud, and each of the plurality of plates being configured to be separately and directly detachably coupled to the shroud while the shroud is coupled to the exterior surface of the helmet.

20. A modular shroud system comprising:

a shroud configured to be coupled to a helmet; and a plurality of plates including a first plate having a first mounting feature and a second plate having a second mounting feature different than the first mounting feature, each of the plurality of plates being configured to be separately and directly detachably coupled to the shroud, wherein each of the first plate and the second plate is configured to be attached to and detached from the shroud while the shroud is coupled to the helmet, wherein the first mounting feature and the second mounting feature are each configured to couple a corresponding accessory device to the helmet, wherein the shroud includes a rail configured to overlap at least a portion of a plate of the plurality of plates when the plate is coupled to the shroud, the rail configured to at least partially secure the plate to the shroud, wherein the rail is a first rail and the shroud includes a second rail parallel to the first rail, and wherein each of the plurality of plates includes a first chamfered side edge configured to snap fit under the first rail, and a second chamfered side edge configured to snap fit under the second rail when each of the plurality of plates is secured to the shroud.

* * * * *